United States Patent [19]

Pillnik

[11] 3,989,161

[45] Nov. 2, 1976

[54] CONTAINER END CLOSURE

[75] Inventor: Burton Frank Pillnik, Cary, Ill.

[73] Assignee: American Can Company, Greenwich, Conn.

[22] Filed: Mar. 3, 1976

[21] Appl. No.: 663,351

[52] U.S. Cl. ..... 220/273
[51] Int. Cl.[2] ..... B65D 41/32
[58] Field of Search ..... 220/270–273

[56] References Cited

UNITED STATES PATENTS

| | | | |
|---|---|---|---|
| 3,643,832 | 2/1972 | Khoury | 220/273 |
| 3,863,801 | 2/1975 | Pillnik | 220/273 |

*Primary Examiner*—George T. Hall
*Attorney, Agent, or Firm*—Robert P. Auber; Thomas M. Galgano; Ira S. Dorman

[57] ABSTRACT

A container end closure includes an end wall having a removable panel defined therein by a rupturable peripheral score, and a pull tab having a nose portion at one end, a handle portion at its opposite end, and marginal edge portions which extend generally toward the end wall and terminate short of the outer end of its nose portion. At least one depressed section is formed in the removable panel of the end wall to accommodate the terminal ends of the marginal portions of the tab, upon pivoting of the tab when the handle portion is raised. This construction ensures that initial contact with the panel is made by the outer end of the nose portion of the tab, thereby maximizing the effectiveness of force applied for score rupture initiation.

9 Claims, 5 Drawing Figures

CONTAINER END CLOSURE

BACKGROUND OF THE INVENTION

End closures for cans and other containers and, more particularly, those of the so-called "easy-open" type are, of course, well known in the art. Typically, they include an end wall having a removable panel defined therein by a rupturable score which, upon severance and removal of the panel, provides a dispensing aperture. Generally, score rupture and panel removal are both effected by use of a pull tab having a nose portion at one end and a handle portion at its opposite end. The tab is so mounted on the panel as to be pivotable into contact adjacent the score, so as to initiate severance thereof, and to thereafter facilitate tearing of the panel away from the remainder of the end wall.

Often, the tab must be rigidified when relatively soft or maleable materials, such as aluminum, are employed. As typified by the tab construction illustrated in U.S. Pat. No. 3,863,801, such reinforcement may be effected by downwardly curling the marginal portions of the tab, the outer end of the tab remaining uncurled to provide a relatively sharp tip, for optimum score initiation. However, when a tab of such construction is pivoted to effect opening, the two terminal ends of its curled marginal portions will tend to contact the panel simultaneously with, or before, the tip of the nose. The opening force applied will, as a result, be distributed over an extended area of the panel, thereby precluding the transmission of maximum force to the tip of the tab and, in turn, necessitating the use of an undue amount of effort to effect score initiation. This is not only inconvenient from the consumer's standpoint, but it may, indeed, cause the tab to bend, break and/or be disengaged from the panel.

Accordingly it is an object of this invention to provide a novel can end closure which is simple, highly effective, and of relatively inexpensive construction.

It is also an object of this invention to provide a novel can end closure which affords desirable opening characteristics and maximizes the effectiveness of applied score rupture-initiating force.

It is a more particular object of this invention to provide a novel can end closure of the easy-open type having the foregoing attributes and characteristics.

SUMMARY OF THE INVENTION

It has now been found that the foregoing and related objects of the invention are readily attained in a container end closure which includes a wall having a removable panel defined therein by a rupturable score, preferably formed at its periphery; an opening tab having a nose portion at one end and a handle portion at its opposite end; and means for relatively resiliently securing the tab to the panel, intermediate the end portions of the tab, with the outer end of its nose portion disposed adjacent the score. The tab has marginal portions along both sides thereof extending generally toward the wall and terminating short of the outer end of the nose portion, and the panel has formed therein at least one depressed section underlying each of the terminal ends of the tab marginal portions. Upon lifting of the tab handle portion to pivot the tab about the securing means, the terminal ends of the marginal portions are received within the depressed section of the panel, whereby initial contact between the tab and panel is made by the outer end of the nose portion, to effectively initiate rupture of the score.

Preferably, the depressed section of the panel comprises an indentation of generally circular configuration underlying each of the terminal ends of the tab marginal portions. Most desirably, the removable panel has formed therein a rupturable ancillary score, passing inwardly of the tab securing means and extending laterally therefrom which, upon rupture thereof, facilitates pivoting of the tab, and initially vents the container. In the particularly preferred embodiments, the nose portion of the tab has formed therein a depending rib of substantially V-shaped cross-section, extending longitudinally therein inwardly from the outer end thereof, and being disposed at a level intermediate the panel and the remainder of the nose portion. As a result, initial contact between the tab and panel will occur at the rib. Finally, the end closure is preferably fabricated from metal, and its end wall will generally be of circular configuration.

DETAILED DESCRIPTION OF THE ILLUSTRATED EMBODIMENT

Figure 1:
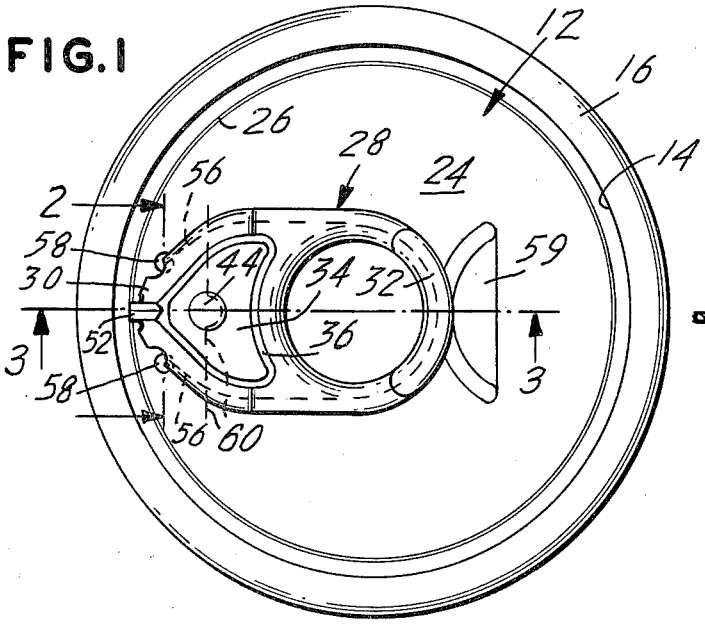
FIG. 1 is a plan view of a can end closure embodying the present invention.
Figure 2:
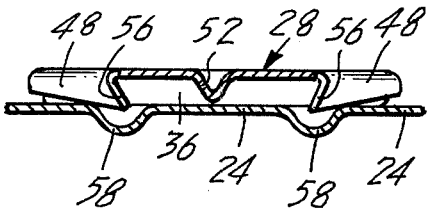
FIG. 2 is a fragmentary cross-sectional view of the end closure of FIG. 1, along line 2—2 thereof and drawn to an enlarged scale.
Figure 3:
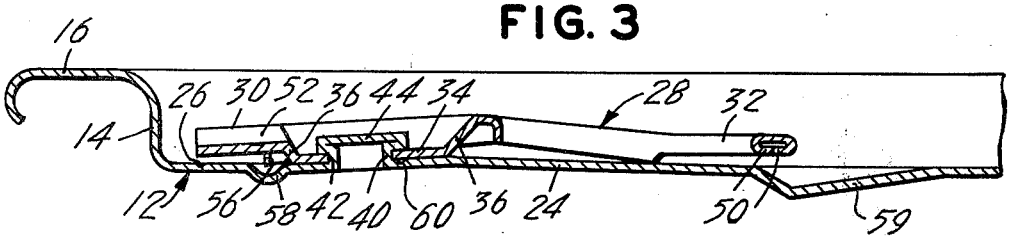
FIG. 3 is a fragmentary cross-sectional view along line 3—3 of FIG. 1, drawn approximately to the scale of FIG. 2.
Figure 4:
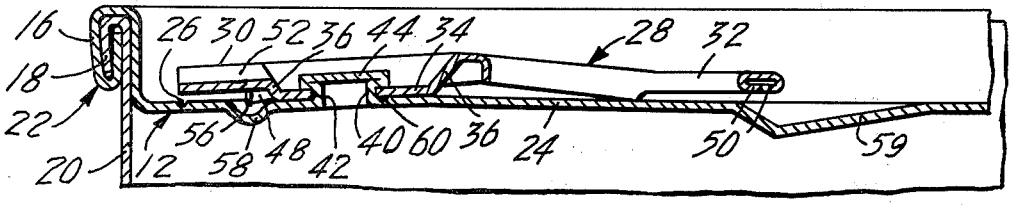
FIG. 4 is a fragmentary cross-sectional view similar to that of FIG. 3, showing the can end closure attached to a container body by means of a double seam.

Turning now in detail to the appended drawing, therein illustrated is a can end closure embodying the present invention and including a substantially flat, circular end wall, generally designated by the numeral 12, which is joined by a countersink wall 14 to a curled, circumferential flange 16. The flange 16 is adapted to be interfolded with flange 18 at the end of can body 20 to form a double seam, generally designated by the numeral 22, and shown in FIGS. 4 and 5. The end wall 12 has a removable panel 24 defined therein by a rupturable peripheral score 26, which is formed adjacent the countersink wall 14 and encompasses substantially the entire end wall 12, thus defining a full panel opening therein.

An opening tab, generally designated by the numeral 28, has a nose portion 30 at one end, a gripping ring or handle portion 32 at its other end, and a generally triangular, depressed web portion 34 located therebetween and joined thereto by a peripheral shoulder portion 36, the latter having a hole 42 formed therethrough. The tab 28 is secured to the removable panel 24 by a rivet, which is integrally formed in the panel 24 and comprises an upstanding cylindrical shank portion 40, extending through the hole 42 of the web portion 34, and a head portion 44, extending thereover and bearing tightly thereon. The tab 28 is so positioned that its nose portion 30 lies over the peripheral score 26. An ancillary score 60 extends, in the removable panel 24, behind the shank portion 40 of the rivet and chordally to opposite sides thereof.

A curled peripheral flange portion or skirt 48 extends along both sides of the tab 28, terminating short of the tip of its nose portion 30, and serving to rigidify the tab 28; the edges 50 of the handle portion 32 are bent inwardly for the same reason. In addition, the tip of the nose portion 30 is reinforced by a V-shaped cleft or rib 52, which extends longitudinally therein from its outer end to the shoulder 36. The bottom of the rib 52 lies at a level intermediate the remainder of the nose portion 30 and the surface of the panel 24, to make initial contact therewith.

Each of the two terminal end portions or corners 56 of the skirt 48 of the tab 28 overlies one of a pair of circular indentations or dimples 58 formed in the removable panel 24. The end of the handle portion 32, is disposed directly above a sloped depression 59, which is also formed in the removable panel so as to permit ready grasping of the handle portion 32 by the user.

Figure 5:
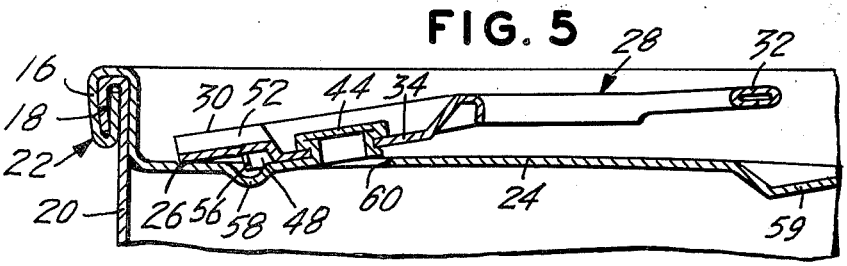
FIG. 5 is a view similar to that of FIG. 4, showing the pull tab pivoted to a position at which rupture of the ancillary score has been effected and rupture of the peripheral score is imminent, in which position the terminal end portions of the depending marginal skirt of the tab are received in the dimples formed in the panel of the closure.

Referring now to FIG. 5, upon lifting of the tab handle portion 32, the ancillary score 60 ruptures, thus facilitating further pivotal movement of the tab 28 and (in the case of a container under pressure or vacuum) affording initial venting. Continued lifting of the handle 32 brings the tip of the cleft 52 into contact with the panel 24, at or closely adjacent the primary score 26, to initiate its rupture, with the terminal edge portions 56 of the skirt 48 being received with the underlying depressions 58. As can be appreciated, the clearance for the edge portions 56, which is provided by the depressions 58, ensures that initial contact between the tab 28 and removable panel 24 occurs at the tip of the cleft 52, thus maximizing the effectiveness of the force applied to initiate severance of the removable panel 24. Further pivoting of the tab 28 extends the severance of the primary score 26, so that rearward force on the tab handle 32 may eventually effect complete removal of panel 24, and thus full opening of the can.

It should be appreciated that the end closure embodied by the instant invention may be employed with variously-configured containers and cans, which need not be circular, as shown. Additionally, although the end closure illustrated in the drawings is of the "full-panel, easy-open" type, in which the primary score defines a removable panel which encompasses substantially the entire end wall, the primary score may instead define a removable section which constitutes only a portion of the end wall. It should also be noted that the tab reinforcing flange portion or skirt may be of a variety of configurations, and that the can end closure may be fabricated from any rupturable material, albeit that steel or aluminum will normally be employed.

Thus, it can be seen that the present invention provides a novel container end closure which is simple, highly effective and of relatively inexpensive construction. The closure affords desirable opening characteristics, and maximizes the effectiveness of applied score rupture-initiating force. In particular, the invention provides a novel can end closure of the easy open type, having the foregoing attributes and characteristics.

What is claimed is:

1. A container end closure comprising: a wall having a removable panel defined therein by a rupturable primary score; an opening tab have a nose portion at one end and a handle portion at its other end; means for relatively resiliently securing said tab, intermediate said end portions thereof, to said panel, with the outer end of said nose portion disposed adjacent said score, said tab having marginal portions along both sides thereof extending generally toward said wall and terminating short of said outer end of said nose portion, and said panel having formed therein at least one depressed section underlying the terminal ends of said marginal portions of said tab, whereby, upon lifting of said handle portion to pivot said tab about said securing means, said terminal ends of said marginal portions are received within said depressed section of said panel, so that initial contact between said tab and panel is made by said outer end of said nose portion, to effectively initiate rupture of said score.

2. The closure of claim 2 wherein said depressed section comprises an indentation underlying each of said terminal ends of said tab marginal portions.

3. The closure of claim 2 wherein said indentations are of a generally circular configuration.

4. The closure of claim 1 wherein said primary score is formed in said end wall at its periphery.

5. The closure of claim 4 wherein said removable panel has formed therein a rupturable ancillary score passing inwardly of said tab-securing means and extending laterally therefrom, which score, upon rupture, facilitates pivoting of said tab.

6. The closure of claim 1 wherein said nose portion of said tab has formed therein a depending rib extending longitudinally inwardly from said outer end thereof and disposed at a level intermediate said panel and the remainder of said nose portion, so that initial contact between said nose portion and said panel occurs at said rib.

7. The closure of claim 5 wherein said rib has a substantially V-shaped cross-section.

8. The closure of claim 1 wherein said wall is of a generally circular configuration.

9. The closure of claim 1 wherein said closure is fabricated from metal.

* * * * *